United States Patent [19]

Haselton

[11] 4,054,104

[45] Oct. 18, 1977

[54] SUBMARINE WELL DRILLING AND GEOLOGICAL EXPLORATION STATION

[76] Inventor: Frederick R. Haselton, 1205 Fallsmead Way, Rockville, Md. 20854

[21] Appl. No.: 602,506

[22] Filed: Aug. 6, 1975

[51] Int. Cl.[2] ..... B63B 35/44

[52] U.S. Cl. ..... 114/264; 175/8; 166/.5

[58] Field of Search ..... 114/.5 R, .5 D, 16 R, 114/16.4, 16.5, 16.6, 264; 9/8 P; 61/46.5, 46; 175/5, 7, 8, 10; 166/.5

[56] References Cited

U.S. PATENT DOCUMENTS

| | | | |
|---|---|---|---|
| 3,327,668 | 6/1967 | Von Schultz | 114/.5 D |
| 3,450,083 | 6/1969 | Haselton et al. | 114/16 R |
| 3,572,041 | 3/1971 | Graaf | 114/.5 D |
| 3,621,911 | 11/1971 | Baker et al. | 166/.5 |
| 3,902,553 | 9/1975 | Jergins | 175/8 |

*Primary Examiner*—Trygve M. Blix
*Assistant Examiner*—Jesus D. Sotelo
*Attorney, Agent, or Firm*—Pollock, Vande Sande & Priddy

[57] ABSTRACT

A submarine well drilling and geological exploration station includes an inner pressure hull specially configured for submerged drilling and exploration and an outer fairing hull of conventional submarine design. The pressure hull is divided by an air lock into an atmospheric pressure chamber and a superatmospheric pressure chamber. Ballast tanks are arranged so that the station may be rotated from a horizontal in-transit orientation to a vertical drilling and exploration orientation. The superatmospheric chamber permits exploration and drilling operations therein in the vertical orientation. A tandem propeller system is used to stabilize the station in position while in the vertical orientation and to propel the station from location to location while submerged in the horizontal orientation.

13 Claims, 4 Drawing Figures

SUBMARINE WELL DRILLING AND GEOLOGICAL EXPLORATION STATION

BACKGROUND OF THE INVENTION

During the past 25 to 30 years, considerable attention has been devoted to means for recovering mineral wealth from the ocean floors of the world. Particularly, recovery of petroleum from submerged oil fields has been the subject of intense research and development; moreover, recovery of manganese nodules and other ocean bottom resources has also been studied with great interest.

In the field of petroleum recovery, recent years have seen the extensive use of permanent off-shore drilling platforms, drill ships, and semi-submersible, mobile platforms. These approaches to oil prospecting and recovery have developed primarily from a desire to use the fully-developed land-based technology in the ocean environment. While drilling in submerged formations presents a whole host of problems peculiar to it alone, much, if not most, of the drilling equipment used on present-day off-shore platforms or semi-submersibles would be familiar to those in the art experienced primarily in land-based operations.

Semi-submersible platforms are in ever-increasing use today, primarily due to their inherent ability to be moved relatively easily from drilling site to drilling site, without significant disassembly. Because the elevated platform used in semi-submersibles must necessarily support large, variable masses of equipment, supplies and personnel, such devices inherently require large metacentric heights. To ensure positive stability against capsizing due to all conceivable loading and sea state conditions, semi-submersibles require the use of support columns for the drilling platform which have rather large waterplane areas where the columns pierce the water while the semi-submersible is in its submerged, operation position. For such systems, heave resonance commonly occurs in seas having periods in the 14 to 30 second range. This resonance range is adequate in most sea conditions, but, unfortunately, it is the heavier seas with wave lengths up to 305 meters and wave heights of up to 30.5 meters which are associated with periods in this range. Under the influence of such seas, present-day semi-submersibles frequently experience heave amplitudes of as much as 40% of the wave height, which may be as large as 12 to 15 meters. Whether the platform is used for oil drilling or other geological exploration, such motion usually presents serious problems and may cause all operations to cease. The economic losses due to such down time can run to millions of dollars per year for an individual semi-submersible platform.

In addition to the above problems of heave motion, semi-submersibles are rather slow, ungainly devices to move from place to place, due to their great size, low propulsion power and poor transit hydrodynamic design. Such platforms may be moved only under the most favorable sea states at low speeds. Furthermore, the extreme sea induced loading conditions experienced by the semi-submersibles require the extensive use of expensive, heavy construction steel to provide adequate safeguard against failure.

From the above, it is apparent that a need exists for a type of geological exploration and well drilling station or platform which will experience only slight heave movement during worst case sea conditions; will be capable of substantially higher speeds during transit from location to location under any sea state; and, yet, will require much less extensive use of the expensive construction materials in use in current semi-submersible platforms.

OBJECTS OF THE INVENTION

An object of the invention is to provide a geological exploration and well-drilling station capable of substantially submerged operation on site, which experiences virtually negligible heave motion due to ambient sea state.

Another object of the invention is to provide such a device which is capable of high speed submerged transit, while operating at a submerged depth of about one hull body diameter.

Another object is to provide such a device which will contain less structural steel and therefore be less expensive than existing semi-submersible platforms.

Still another object is to provide such a device which may be rotated from a horizontal transit orientation to a vertical drilling or exploration orientation, having a propulsion system adapted for use during transit for horizontal movement and during operation for vertical position maintenance or station keeping.

A further object of the invention is to provide such a device in which power plants for propulsion, station keeping and exploration are maintained in essentially constant contact with the ambient atmosphere above the water surface, whereby storage battery, nuclear or other non-combustion power plants are not required.

Yet another object of the invention is to provide such a device in which crew members conduct substantially all drilling or exploration operations in a dry environment using essentially conventional off-shore drilling and exploration equipment.

Still another object of the invention is to provide such a device which has only a small cross-sectional area thereof projecting through the water surface in the drilling orientation to minimize heave sensitivity.

These objects of the invention are merely exemplary; thus, those skilled in the art may perceive other desirable objects or advantages inherently achieved by the invention. Nonetheless, the scope of the invention is to be limited only by the appended claims.

SUMMARY OF THE INVENTION

The above objects of the invention and other advantages are achieved by the disclosed structure which comprises a pressure hull which has at least one selectively openable and closable access hatch through its wall at one end thereof. Ballasting and deballasting apparatus is provided for selectively moving the hull between an essentially vertical orientation suited for geological exploration and drilling of a submerged surface downwardly through the access hatch in its open position; and an essentially horizontal orientation suited for submerged transit of the apparatus with the access hatch in its closed position. Attached to the hull is a propulsion and station keeping system for maintaining the hull at a predetermined submerged station in the water in the vertical orientation and for propelling the hull through the water in the horizontal orientation. A compression and decompression chamber divides the pressure hull into an atmospheric pressure chamber and a superatmospheric pressure chamber, with access hatches providing communication between the two chambers.

Another feature of the invention comprises an axial extension of the pressure hull which is adapted to extend above the surface of the water when the hull is in its vertical orientation. The extension has a small waterplane area where it extends through the surface, to provide enhanced stability in heave motion. A collapsible helicopter pad is attached to the upper end of the extension. Snorkeling means are also provided within the extension for admitting air to pressure hull in both the vertical and horizontal orientations as well as to provide for exhaust gas venting to the atmosphere. Means are also provided for pressurizing the superatmospheric chamber to prevent water from entering it when the access hatch is opened in the vertical orientation.

DETAILED DESCRIPTION OF THE PREFERRED EMBODIMENT

Figure 1:
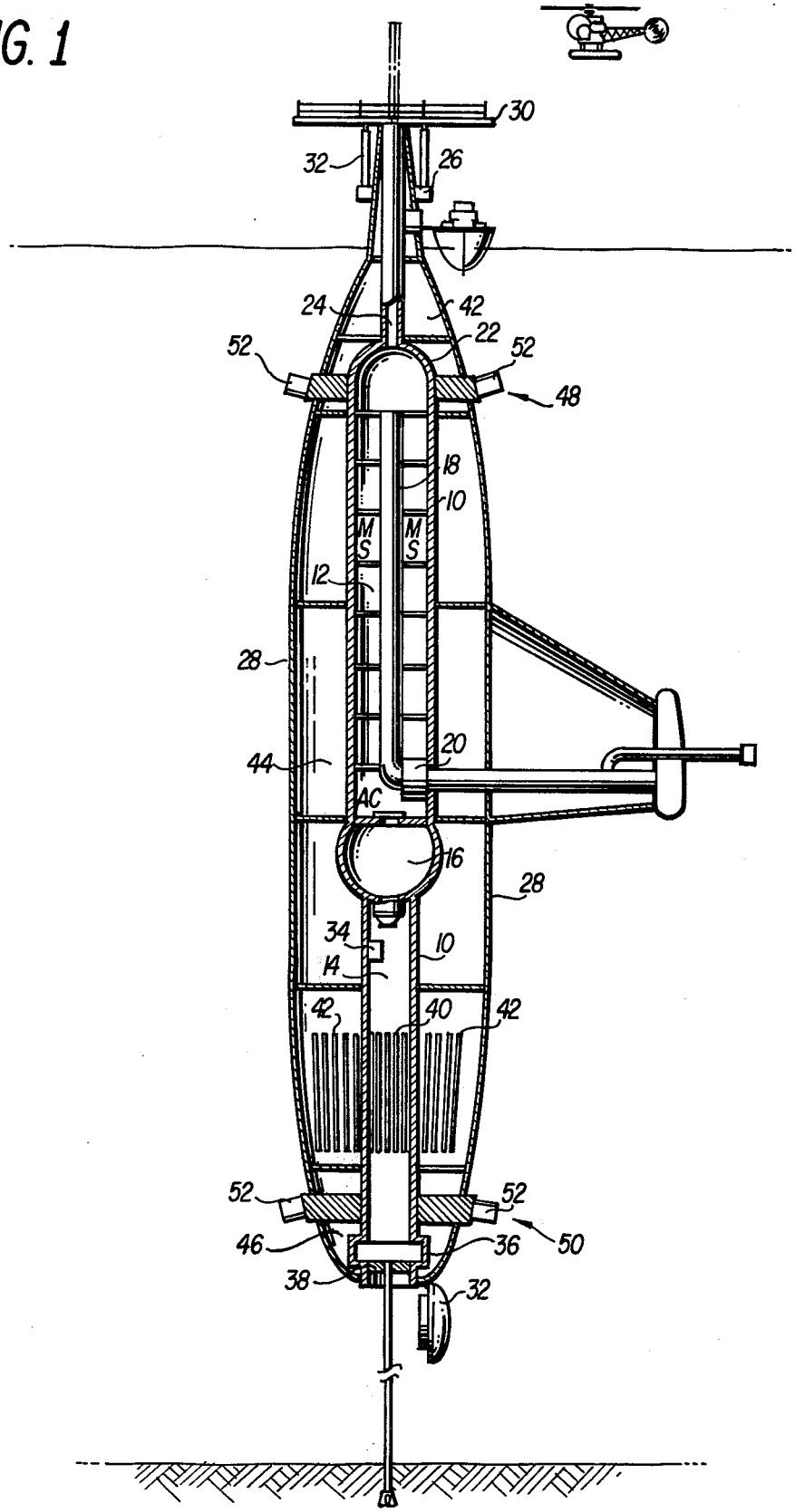
FIG. 1 shows an elevation view, in section, of a submerged geological exploration and well-drilling station according to the invention, in its vertical, operating orientation.

There follows a detailed description of a preferred embodiment of the invention, reference being made to the drawings in which like reference numerals designate like elements of structure in each of the several Figures.

In accordance with the present invention, the platform from which drilling or other geological exploration is conducted is relocated from the above surface position used in the prior art to a sub-surface position. This relocation provides substantial advantages due to improved platform stability during vertical orientation for drilling and exploration. Also, where techniques of conventional submarine design are used, vastly improved mobility is achieved in the submerged condition during horizontal orientation. The basic components of a conventional land-drilling system are retained, though rearranged somewhat in appearance, including derrick, draw works, rotary table (if required), drill pipe, casings and bulk storage for drilling mud, power plant fuel, cement and the like. As in the permanent and semi-submersible platforms, crew's quarters and resupply facilities are provided in the submerged station.

Referring to FIG. 1, the structure and function of the invention may be understood by those in the art. FIG. 1 illustrates the invention in its vertical, or drilling and exploration, orientation. A central pressure hull 10 extends essentially along the vertical axis of the station. Hull 10 is designed to withstand sea water pressure and is divided into an upper, atmospheric pressure chamber 12 and a lower, superatmospheric pressure chamber 14. A compression and decompression chamber 16, of conventional design, separates chambers 12 and 14 and permits crew members to move from one chamber to the other without depressurizing chamber 14. Preferably, two such chambers 16 are provided to permit crews to enter and leave chamber 14 simultaneously. Chamber 16 would also serve as a refuge in the event of a well blow-out or other accident.

Atmospheric chamber 12 is divided into a plurality of compartments interconnected by a central passageway 18 extending from maneuvering and control spaces 20, located just above chamber 16, to the upper end of chamber 12. Some of the compartments on either side of passageway 18 include conventional accommodations for crew's quarters, galley, mess hall, infirmary and related life support facilities. Other compartments, labelled "MS" for machinery spaces, house electrical power generating equipment such as gas turbine-generators, which generate the electrical power required for all operations in the illustrated vertical orientation, including station-keeping, and in the horizontal orientation of FIG. 4, including maneuvering and propulsion. Although most machinery in these spaces should be selected to operate in all orientations between vertical and horizontal, major components such as the turbine -generators may be gimballed as necessary to maintain them in their preferred operating orientation at all times. One important component powered by the generators is an air compressor system, labelled "AC", which is used to pressurize chamber 14, as will be discussed subsequently. In some instances, it may be necessary to provide dual, orthogonal facilities, one for the horizontal and one for the vertical orientation, as will be understood by those in the art.

At its upper-most end 22, pressure hull 10 includes an access tube 24, which extends to a location above the water surface when the station is in its vertical, drilling orientation. Tube 24 is chosen to be approximately 18 meters in length in the preferred embodiment, so that it may be extended sufficiently far above the surface to facilitate transfer of personnel and supplies. As indicated schematically in FIG. 3, the upper end of access tube 24 includes an access hatch 70 for personnel and/or supplies, an air intake 74 and generator exhaust 76 of the faimilar "snorkel" variety, plus means 72 for extending communications antennae, visual and audible warning devices and related navigational equipment. A hatch 26 for larger supplies may be provided in the side of tube 24 to facilitate resupply from small tenders or lighters, as indicated.

To minimize the heave response of the station in its vertical orientation, tube 24 is chosen to be much smaller than the diameter of hull 10. In practice, it should be only so large as necessary to accommodate personnel access, small supplies, "snorkel" tubes and communications connections. With a small waterplane area where tube 24 extends through the surface, the driving force in heave motion will be small, yielding only slight heave amplitude for the massive drilling station, as waves move past it. The driving force is proportional to the product of the waterplane area and the wave height. Assuming a diameter at the waterplane of 3 meters, the area will be about 7.1 $m^2$, compared to as much as 300 $m^2$ in conventional semi-submersibles. Thus, in equivalent sea states, the heave response of the invention is vastly improved relative to prior art semi-submersible platforms of similar mass.

Surrounding pressure hull 10 and its extension or access tube 24 is a streamlined, faired hull 28. Hull 28 serves primarily to facilitate submerged propulsion of the station from location to location, and is patterned generally after conventional high-speed hull designs such as the well-known "Albacore" type hull. At the upper end of tube 24 and faired hull 28, a collapsible helicopter pad 30 is provided, which is supported by hydraulically extensible struts 32 when deployed as shown. Heliport 30 is sized to permit helicopters to land for ferrying personnel and non-bulk supplies to and from the station.

Continuing with regard to FIG. 1, it is seen that the lower end of pressurized chamber 14 includes a large water-tight hatch 32 which is opened in the illustrated orientation to permit drilling equipment or other exploratory or mining devices to be lowered downwardly through hatch 32 to the sea floor. Hatch 32 is closed in the horizontal orientation shown in FIG. 4, to prevent flooding of chamber 14 and a resultant "bow heavy" vessel. To maintain chamber 14 filled with an air environment, air compressors AC are used to provide a sufficient pressure in chamber 14 for supporting a column of water equal in height to the distance from the water surface to the opening of hatch 32. For a depth of about 100 meters, a superatmospheric pressure of somewhat less than 10 bar is required, which is within the capabilities of present-day air compression equipment. A helium-oxygen atmosphere is preferred to reduce danger of "bends" during decompression of the crew members and to avoid nitrogen narcosis.

Chamber 14 includes at its upper end a winch 34 or similar device suitable for use in lowering drilling pipe, casings or other exploratory equipment downwardly through open hatch 32. The height of chamber 14 is chosen to equal the length of three sections of conventional drill pipe to accommodate the continued use of normal land-based procedures where three previously connected sections are inserted into or removed from the drill string at one time. The lower end of chamber 14 includes an enlarged working area 36 and a conventional rotary table 38, electrically powered by the turbine generators. Of course, where turbine type drilling equipment is used or non-drilling operations are in progress, rotary table 38 could be omitted or temporarily removed. An initial supply of drilling pipe and casing is stored vertically on racks on the walls of chamber 14, as indicated schematically at 40; and additional piping is stored in the spaces between pressure hull 10 and faired hull 28, as indicated schematically at 42. As will be appreciated by those in the art, the piping stored at 42 may be easily removed by providing access doors (not shown) from the interior of chamber 14, which would be opened for pipe removal when the water level in chamber 14 has been allowed to rise to just above the access doors. Alternatively, the pipe may be lowered through access openings (not shown) in the lower extremity of faired hull 28 and subsequently drawn up through the hatch opening of chamber 14.

The space between pressure hull 10 and faired hull 28 is divided into compartments for storage of bulk materials such as drilling mud, cement, fuel for the turbine generators and the like. This space also includes conventional submarine ballast and trim tanks located and sized as necessary to permit the station to maintain neutral buoyancy and to be rotated between the operating position shown in FIG. 1 and the in-transit position shown in FIG. 4. Such tanks are indicated schematically at 42, 44 and 46; however, those skilled in the art will appreciate that their precise location will vary depending on the weight and location of the equipment and supplies carried by the station. In any event, the design techniques for locating and sizing such tanks are well-known to those in the art. Because faired hull 28 is not a pressure hull, it may be of relatively thin section, compared to pressure hull 10.

The propulsion and station keeping system is indicated at 48, 50. In the illustrated embodiment, this system comprises a pair of spaced peripheral propulsion units mounted for rotation around the pressure hull 10 and powered by the turbine generators. Each unit includes a plurality of pitch-adjustable blades 52 pivotally mounted thereon and means to adjust the blade pitch while rotating the blades around the hull, to provide maneuvering control in six-degrees of freedom. This type of propulsion unit is disclosed in my prior art U.S. Pat. Nos. 3,101,066; 3,291,086; and 3,450,083, the contents of which are incorporated by reference herein. This type of propulsion and station keeping system permits precise station keeping in the vertical orientation without the need for mooring chains; and is also efficient as a propulsion means in the horizontal orientation, providing high speeds with precise depth and course control. While such a system is preferred, those skilled in the art will realize that other station-keeping and propulsion systems may be used without departing from the scope of the invention, such as a conventional submarine screwpropeller and rudder, combined with orthogonal thrusters and conventional diving planes. Of course, where precise control is not required for each degree of freedom (heave, sway, surge, pitch, yaw or roll) systems having maneuvering control for less than six degrees may be used without departing from the scope of the invention.

Figure 2:
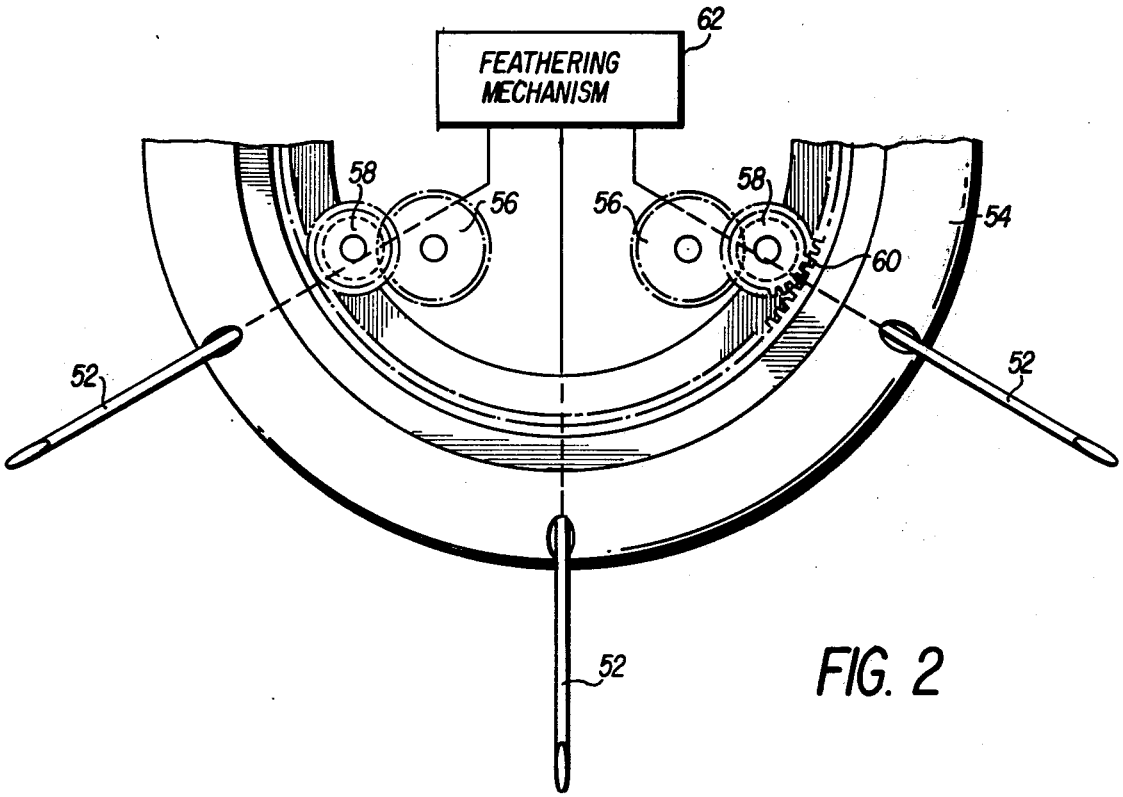
FIG. 2 shows a schematic representation of a propulsion system suited for use in the invention.

FIG. 2 shows the basic elements of the preferred propulsion and station keeping apparatus. The details thereof are shown in my U.S. Pat. No. 3,450,083; however, the devices shown in my other patents are also suitable as mentioned previously. Each of the propulsion units comprises a ring 54 having a diameter substantially equal to the cross-sectional diameter of the ends of the fairing hull 28. Blades 52 are pivotally mounted in ring 54 and may have their rotational axis extending radially from and normal to the longitudinal axis of hull 10. However, it has been found preferable to rake the rotational axis of the blades toward the ends of the hull at an angle between 25° and 30° from the radial position, to provide a proper balance between the propulsion capability and the maneuvering capability of the vessel. Rings 54 are mounted in suitable bearings and rotated by electrical motors 56 via pinion gears 58 and circular drive gear 60. Suitable means such as feathering mechanism 62 are provided for changing the pitch of the blades to provide 6° of freedom for maneuvering control. The details of feathering mechanism 62 also are shown in my U.S. Pat. No. 3,450,083.

Figure 3:
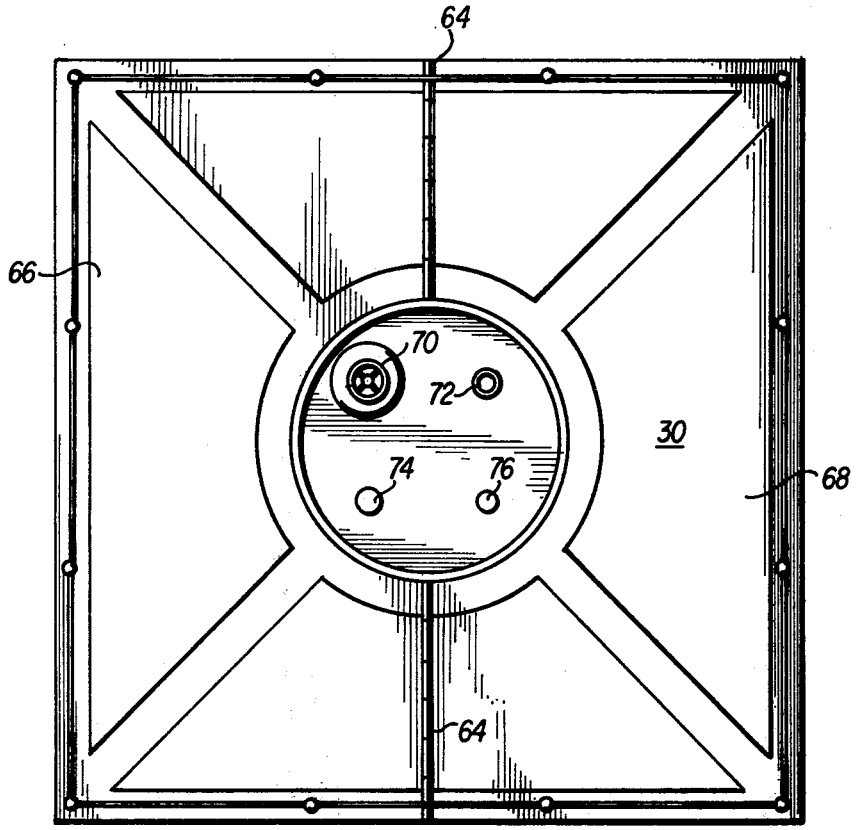
FIG. 3 shows a plan view of a helicopter pad attached to and extended from the above surface portion of the invention, while the station is in its vertical, operating orientation.

FIG. 3 shows a plan view of helicopter pad 30. Radially extending hinges 64, attached to pressure hull 10 and/or fairing hull 28, rotatably support rigid sections 66 and 68 of pad 30 to permit hydraulic struts 32 to deploy sections 66 and 68 to their illustrated position. An access hatch 70 permits personnel access to pad 30 from the interior of pressure hull 10. Antenna or signalling arrays may be extended through port 72 in the usual manner. Finally, snorkel inlet 74 and outlet 76 respectively provide passages to admit air to the interior of hull and to exhaust stale air and products of combustion. In use, pad 30 would be provided with suitable guard rails or protective enclosures as necessary to provide a safe observation and personnel transfer location.

Figure 4:
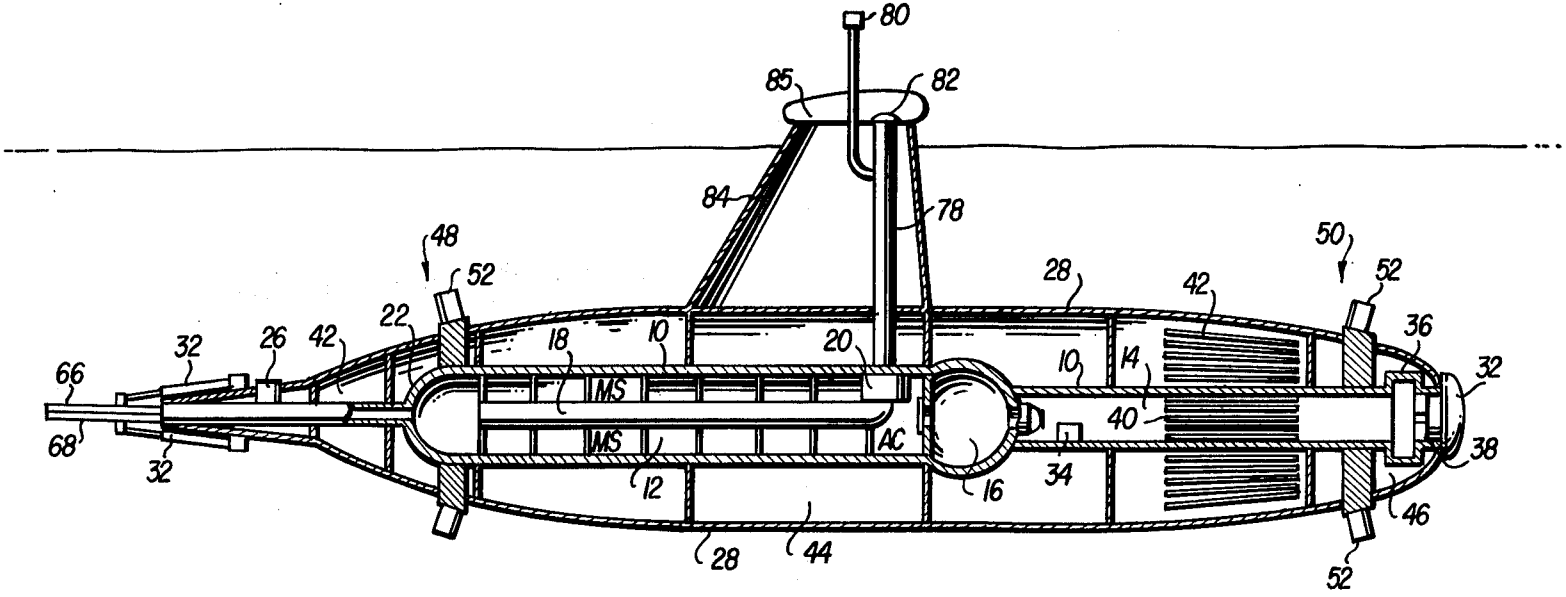
FIG. 4 shows an elevation view, in section, of a submerged geological exploration and well drilling station according to the invention, in its horizontal, in-transit orientation.

FIG. 4 illustrates the invention in its horizontal orientation for transit from station to station. Helicopter pad 30 has been collapsed by hydraulic struts 32 to its illustrated position, to minimize drag. The ballasting of the station has been changed in the familiar manner to rotate the station to the illustrated position. In this orientation, a second personnel access tube 78 is used. Tube 78 extends essentially at a right angle to pressure hull 10 and fairing hull 28, to a distance approximately equal to the maximum diameter of fairing hull 28. A snorkel breather 80 extends from access tube 68 near its upper end to permit submerged operation in the illustrated position. A water-tight hatch 82 closes the upper end of tube 78. Finally, tube 78 is encased within a faired conning tower or "sail" structure 84, in the usual manner. Sail 84 also functions in the vertical orientation of FIG. 1, to help damp any tendency for the station to rotate about its long axis due to torque applied at the rotary table, for example. Observation bridge platform 85 serves to shelter the lookout during transit in calm weather. A periscope (not shown) may be used during heavy weather transit.

Numerous advantages of the invention are achieved by the disclosed structure. One important advantage is that an estimated one-tenth of the steel used in a conventional semi-submersible (10,000 long tons) will be required for the present exploration station (1000 long tons) to achieve similar drilling and exploration capabilities. Another advantage is the virtual elimination of wave induced motion due to the extremely small waterplane area where the access tube 24 pierces the water surface, compared to the large mass of the station, and due to the precise control possible with the type of station-keeping and propulsion system preferred for the invention. Finally, based on existing submarine speed versus power characteristics, transit speeds of 15 to 18 knots should be attainable with about 10,000 propulsion horsepower installed. These estimates are based upon a station having the following characteristics:

a. Overall length including access tube 24 96 meters
b. Length between propulsion units 48 and 50 74 meters
c. Maximum fairing hull diameter 15.2 meters
d. Diameter of chamber 12 6 meters
e. Diameter of chamber 14 3 meters
f. Length of chamber 12 33 meters
g. Length of chamber 14 32 meters
h. Average height of living and machinery spaces 3 meters
i. Length of access tube 24 18 meters
j. Diameter of access tube 24 and fairing hull at water line 3 meters
k. Fairwater above keel during transit 37 meters
l. Height of snorkel 80 above keel 45 meters For such a vessel, ring-stiffened construction for the pressure hull and fairing hull 28 allows the use of 2 centimeter thick steel for pressure hull 10 and 1 centimeter thick steel for fairing hull 28. With an interior equipment weight of 200 long tons, a total of approximately 704 long tons of construction steel would be required. The dry portions of such a vessel would displace about 1,498 long tons of sea water, which allows 794 long tons to be carried as crew, consumables and ballast. The volume between the hulls of about 12,000 cubic meters would be used for storage and ballast space, as previously indicated. The above dimensions are presented only by way of example and are not intended to limit the scope of the invention in any way. Variations from these dimensions will be required as necessary to increase the pressure hull safety factor; improve the shape of the fairing hull for greater speed in transit; increase storage capacity for consumables; and the like.

Resupply of the exploration station in its vertical orientation may be accomplished with relative ease. Light weight supplies may be carried through either of hatches 70 or 26, as may be convenient. Pumpable supplies such as fuel and drilling mud may be transferred by flexible hose to filling conduits (not shown) located at the upper end of the station. Provision would also be made for delivering produced oil to a surface location for removal by tanker. Drilling pipe and casing may be ballasted in groups and lowered until grappling is possible downwardly through open hatch 32 at the lower end of chamber 14. Helicopters would be used primarily for personnel and light supply transfer.

Having described my invention in sufficient detail to enable one skilled in the art to make and use it, I claim:

1. A self-propelled submarine geological exploration and drilling station, comprising:

a pressure hull having at least one selectively openable and closeable access hatch through a wall thereof;

first means operatively associated with said pressure hull, for selectively moving said hull between an essentially vertical orientation suited for geological exploration and drilling of a submerged surface downwardly through said access hatch in its open position and an essentially horizontal orientation suited for submerged transit of said station with said access hatch in its closed position;

second propulsion and station keeping means attached to said pressure hull for maintaining said station submerged and suspended in said vertical orientation for geological exploration and drilling from a predetermined location in the water above said submerged surface, and also for propelling said station submerged for transit through the water in said horizontal orientation; and at least one compression and decompression chamber dividing said pressure hull into an atmospheric pressure portion located above said chamber in said vertical orientation and a superatmospheric pressure portion located below said chamber in said vertical orientation, said at least one access hatch communicating with said superatmospheric pressure portion, whereby persons working in said superatmospheric pressure portion may conduct said geological exploration or drilling through said at least one access hatch while said station is suspended in said vertical orientation above said submerged surface and said at least one access hatch is open to the surrounding sea.

2. An exploration station according to claim 1, further comprising:

means for pressurizing said superatmospheric chamber to prevent water from entering said superatmospheric chamber when said access hatch is opened in said vertical orientation.

3. An exploration station according to claim 2, further comprising a fairing hull surrounding said pressure hull.

4. An exploration station according to claim 3, wherein second means comprises a pair of spaced peripheral propulsion units mounted for rotation around said pressure hull, pitch adjustable blades pivotally mounted on said propulsion units, and third means operatively connected to said blades for adjusting the pitch of said blades for maneuvering said platform in six degrees of freedom.

5. An exploration station according to claim 3, further comprising:

an axial extension of said pressure hull adapted to extend above the surface of the water while in said vertical orientation said extension having a small waterplane area where it extends through said surface compared to the crossectional area of the hull; and a heliport attached to said extension.

6. An exploration station according to claim 5, further comprising:

first snorkel means located within said extension for admitting air to said pressure hull in said vertical orientation.

7. An exploration station according to claim 1, further comprising a fairing hull surrounding said pressure hull.

8. An exploration station according to claim 1, wherein said second means comprises a pair of spaced peripheral propulsion units mounted for rotation around said pressure hull, pitch adjustable blades pivotally mounted on said propulsion units, and third means operatively connected to said blades for adjusting the pitch of said blades for maneuvering said platform in six degrees of freedom.

9. An exploration station according to claim 1, further comprising:

an axial extension of said pressure hull adapted to extend above the surface of the water while in said vertical orientation said extension having a small waterplane area where it extends through said surface compared to the crossectional area of the hull; and a heliport attached to said extension.

10. An exploration station according to claim 9, further comprising:

first snorkel means located within said extension for admitting air to said pressure hull in said vertical orientation.

11. A self propelled submarine geological exploration and drilling station, comprising:

a pressure hull having at least one selectively openable and closeable access hatch through a wall thereof;

first means operatively associated with said pressure hull, for selectively moving said hull between an essentially vertical orientation suited for geological exploration and drilling of a submerged surface downwardly through said access hatch in its open position and an essentially horizontal orientation suited for submerged transit of said station with said access hatch in its closed position;

second propulsion and station keeping means attached to said pressure hull for maintaining said station submerged and suspended in said vertical orientation for geological exploration and drilling from a predetermined location in the water above said submerged surface, and also for propelling said station submerged for transit through the water in said horizontal orientation; and first snorkel means for admitting air to said pressure hull while in said vertical orientation; and second snorkel means for admitting air to said pressure hull while in said horizontal orientation.

12. A self-propelled submarine geological exploration and drilling station, comprising:

a pressure hull having at least one selectively openable and closeable access hatch through a wall thereof;

first means operatively associated with said pressure hull, for selectively moving said hull between an essentially vertical orientation suited for geological exploration and drilling of a submerged surface downwardly through said access hatch in its open position and an essentially horizontal orientation suited for submerged transit of said station with said access hatch in its closed position;

second propulsion and station keeping means attached to said pressure hull for maintaining said station submerged and suspended in said vertical orientation for geological exploration and drilling from a predetermined location in the water above said submerged surface, and also for propelling said station submerged for transit through the water in said horizontal orientation; and a lateral extension of said pressure hull adapted to extend above the surface of the water while said station is in transit in a submerged condition; and first snorkel means located within said extension for admitting air to said pressure hull in said horizontal orientation.

13. A self-propelled submarine geological exploration and drilling station, comprising:

a pressure hull having at least one selectively openable access hatch through a wall thereof;

a fairing hull surrounding said pressure hull;

first means operatively associated with said pressure hull, for selectively moving said hull between an essentially vertical orientation suited for geological exploration and drilling of a submerged surface downwardly through said access hatch in its open position and an essentially horizontal orientation suited for submerged transit of said station with said access hatch in its closed position;

second propulsion and station keeping means attached to said pressure hull for maintaining said station submerged and suspended in said vertical orientation for geological exploration and drilling from a predetermined location in the water above said submerged surface, and also for propelling said station submerged for transit through the water in said horizontal orientation; and at least one compression and decompression chamber dividing said pressure hull into an atmospheric pressure portion located above said chamber in said vertical orientation and a superatmospheric pressure portion located below said chamber in said vertical orientation, said at least one access hatch communicating with said superatmospheric pressure portion, whereby persons working in said superatmospheric pressure portion may conduct said geological exploration or drilling through said at least one access hatch while said station is suspended in said vertical orientation above said submerged surface and said at least one access hatch is open to the surrounding sea;

means for pressurizing said superatmospheric portion to prevent water from entering said superatmospheric portion when said access hatch is opened in said vertical orientation;

first snorkel means for admitting air to said pressure hull while in said vertical orientation; and second snorkel means for admitting air to said pressure hull while in said horizontal orientation.

* * * * *